US006299554B1

(12) United States Patent
Sinclair et al.

(10) Patent No.: US 6,299,554 B1
(45) Date of Patent: Oct. 9, 2001

(54) THROWING AND CATCHING NET

(76) Inventors: Andrew McKay Sinclair; Louise Mary Sinclair, both of 89C Baldhill Road, RD 3, Pukekohe (NZ)

( * ) Notice: Subject to any disclaimer, the term of this patent is extended or adjusted under 35 U.S.C. 154(b) by 0 days.

(21) Appl. No.: 09/545,859

(22) Filed: Apr. 3, 2000

(30) Foreign Application Priority Data

Apr. 7, 1999 (NZ) ..... 335024

(51) Int. Cl.[7] ..... A63B 63/00

(52) U.S. Cl. ..... 473/435; 473/421; 473/454; 473/462; 473/476

(58) Field of Search ..... 473/421, 422, 473/431, 434, 435, 446, 451, 454, 459, 462, 468, 476, FOR 102, 103, 104, 112, 115; 273/396, 410

(56) References Cited

U.S. PATENT DOCUMENTS

| | | | | |
|---|---|---|---|---|
| 2,992,002 | * | 7/1961 | Bingham, Jr. | 473/421 X |
| 3,697,068 | * | 10/1972 | McDougall | 473/434 |
| 4,264,070 | * | 4/1981 | Torres | 473/434 |
| 4,456,251 | | 6/1984 | Balaz . | |
| 4,489,941 | * | 12/1984 | Shieh | 473/454 X |
| 4,553,751 | * | 11/1985 | Ketchum | 473/435 |
| 4,650,189 | | 3/1987 | Rajacich . | |
| 4,693,472 | * | 9/1987 | Newman et al. | 473/435 |
| 5,613,922 | | 3/1997 | Hsiang . | |
| 5,664,784 | * | 9/1997 | Redlich et al. | 273/396 |
| 5,772,537 | * | 6/1998 | Anderson et al. | 473/435 |
| 5,827,137 | * | 10/1998 | Ishino | 473/459 |
| 5,833,234 | * | 11/1998 | Vavala et al. | 273/410 X |
| 5,857,679 | * | 1/1999 | Ringe et al. | 473/435 X |

FOREIGN PATENT DOCUMENTS

| | | | | |
|---|---|---|---|---|
| 2916262 | * | 10/1980 | (DE) | 473/FOR 115 |
| 304317 | * | 2/1989 | (EP) | 473/FOR 115 |
| 2644073 | * | 9/1990 | (FR) | 473/FOR 115 |
| 397260 | * | 5/1933 | (GB) | 473/FOR 104 |
| 206623 | | 4/1987 | (NZ) . | |
| 80/00663 | * | 4/1980 | (WO) | 473/FOR 115 |
| 84/02475 | * | 7/1984 | (WO) | 473/FOR 115 |

* cited by examiner

*Primary Examiner*—Raleigh W. Chiu
(74) *Attorney, Agent, or Firm*—Welsh & Katz, Ltd.

(57) ABSTRACT

A throwing and catching net comprising a frame supporting a net having one or more layers of lattice adapted to cause a ball thrown at the net to rebound in an unpredictable manner, wherein in use, catching, throwing and/or batting skills can be practiced. A method of using the same.

42 Claims, 3 Drawing Sheets

THROWING AND CATCHING NET

FIELD OF THE INVENTION

Figure 2:
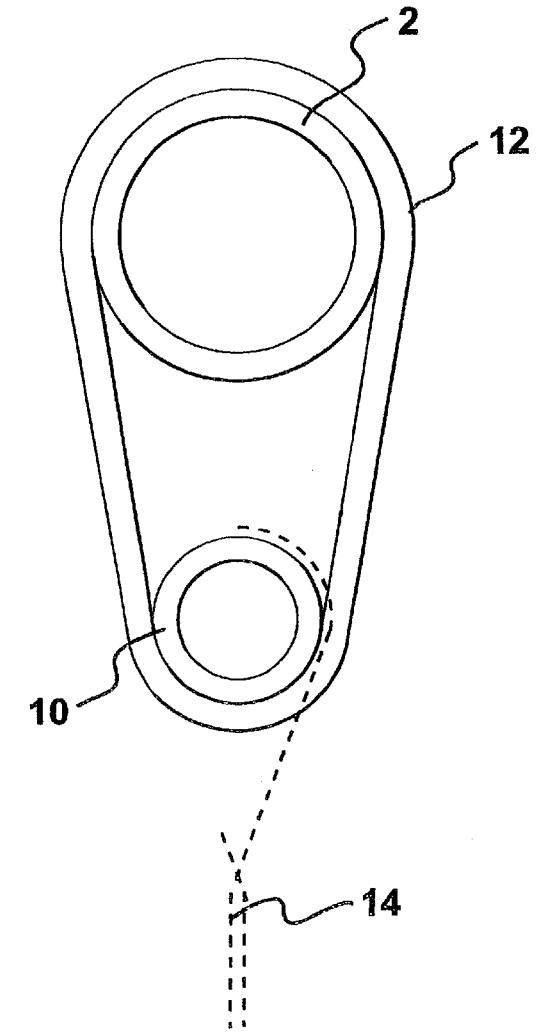

This invention concerns throwing and catching nets for ball games in particular but not limited to a rebound throwing and catching net for the practice of ball catching, throwing and batting skills.

BACKGROUND ART

Players of ball games such as cricket, baseball, basketball, netball and variants of these games must practise both throwing and catching the ball at playing speeds to maintain their judgement and co-ordination.

In the above bat and/or ball games, catchers who stand near the batsman or striker have the motor skills to catch but must develop anticipation in order to react sufficiently quickly. A conventional catching net causes a ball thrown at the net, to rebound with most of the throwers energy. The ball is caught by the thrower or someone close by. As the catcher relies upon the angle of incidence/angle of reflection law to anticipate the rebound angle, reaction speed to balls which are struck and return at odd angles during an actual game is not improved.

This invention addresses this problem.

OBJECT OF THE INVENTION

It is an objective that this invention provides a throwing and catching net which causes a ball to rebound in an unpredictable manner or to at least provide the public with a usefull choice.

SUMMARY OF THE INVENTION

In one aspect, the invention resides in a throwing and catching net including in combination a frame member adapted to support a net, the net comprising one or more layers of lattice adapted to cause an object, typically a ball, thrown at the net to rebound in an unpredictable manner, wherein in use, catching, throwing and/or batting skills of a user can be practised.

The net may be tensioned by a frame or other conventional means for imparting rebound energy to the ball. The frame may have mounting means for erecting the frame on the ground or other support surface. The mounting means may be one or more struts which maintain the frame at a reflex angle to the ground. The frame may have ground engaging parts for locating one edge of the frame on grass.

Preferably the frame is galvanised tube or pipe of 25 mm diameter.

Preferably the sides of the frame are slightly curved away from or towards the net for increased strength and to resist the inwards pulling force of the net.

Preferably the curve of the frame's sides is about 20 mm per metre of length of pipe.

The net may comprise a pair of superimposed lattices. The lattices must be sufficiently close to both impart rebound energy to a ball when the ball is thrown at the net. Preferably one lattice is in contact with the other. The lattices may have rectangular or square cells. If the lattices are too large in relation to the ball diameter the ball passes through the lattices and no rebound occurs. The best result seems to occur when the lattice approaches the size which allows the ball to pass through but which prevents such passage.

The strands of the x-axis in one lattice may be coincident, that is one behind the other, whereas the strands lying on the y-axis of the first lattice are spaced from the strands on the y-axis of the second lattice. The spacing may be greater in the central area of the net than at the border area of the net. Staggering the lattices is an optional feature. Good results are obtained when the lattices are accurately superimposed. The effect of the knots in the lattice seems to be influential. In another version the strands contain knots which are not part of the lattice ie. they are present in order to impart grip to the lattice. Instead beads or like projections may be located in the lattices. In still another version a single lattice is used where the lattice cells have knobbly projections in the throwing direction so as to make contact with the ball as it rebounds.

The central zone may have lattices which are 90 degrees out of phase so that the cells in one axis appear to be only half the height of the cells at the edge of the net. The lattices remain superimposed in the x-axis and this provides the rebounding force whereas the variation in the spacing between the lattices maximises at the centre zone and minimises at the two opposite edges produces the unpredictable directional rebound. Each impact produces a different polygon of forces.

The unpredictable rebound has been best observed when two layers of the same lattice are superimposed.

In yet another version, a third lattice is added to the two superimposed lattices. This ensures that balls of a smaller diameter than cricket balls or baseballs do not pass through the net, This version also provides one side of the net with a more predictable or regular rebound surface for use by novices or users who prefer a more predictable return of the ball, for example, when underarming the ball into the net and then batting it on its return.

The net may be polygonal, oval or circular but these shapes are more difficult to manufacture and offer no advantage over rectangular nets.

The nets may be stretched between opposed pairs of tensioners and the tensioners are in turn suspended tautly within the frame by resilient means. The means may include tension springs but we prefer elastic cord.

The tensioners may modify the stretching force applied to the net. The tensioner may be a tube of resilient material. The tube may be threaded through alternate strands of the net while the cord is spirally wound between the lattices. The tube may be made of a polyethylene ALKATHENE® or galvanised tube.

In another aspect, the invention resides in a method of practising throwing, catching and/or batting skills including the steps of:

1) throwing a ball against a throwing and catching net adapted to cause the ball to rebound in an unpredictable manner, 2) catching or batting the ball accordingly, and 3) repeating steps (1) and (2).

Figure 1:
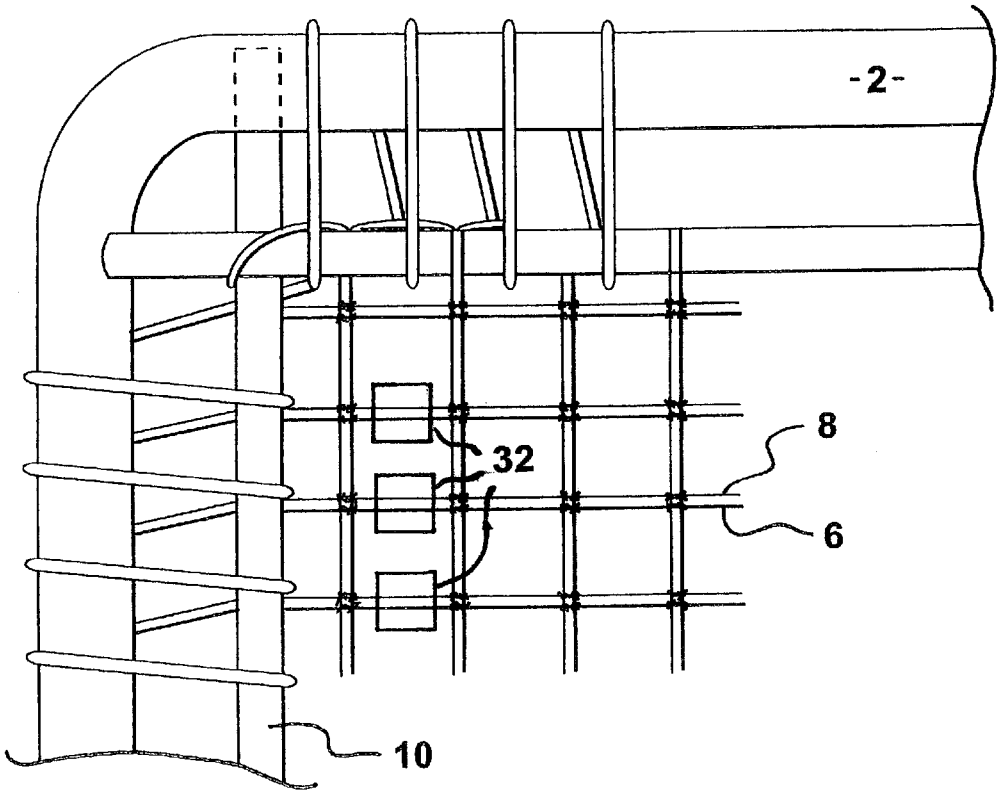

One embodiment of the invention is now described with reference to the accompanying drawings in which:

FIG. 1: is a comer fragment of the frame tensioner and net.

FIG. 2: is an end section through the fragment of FIG. 1.

Figure 3:
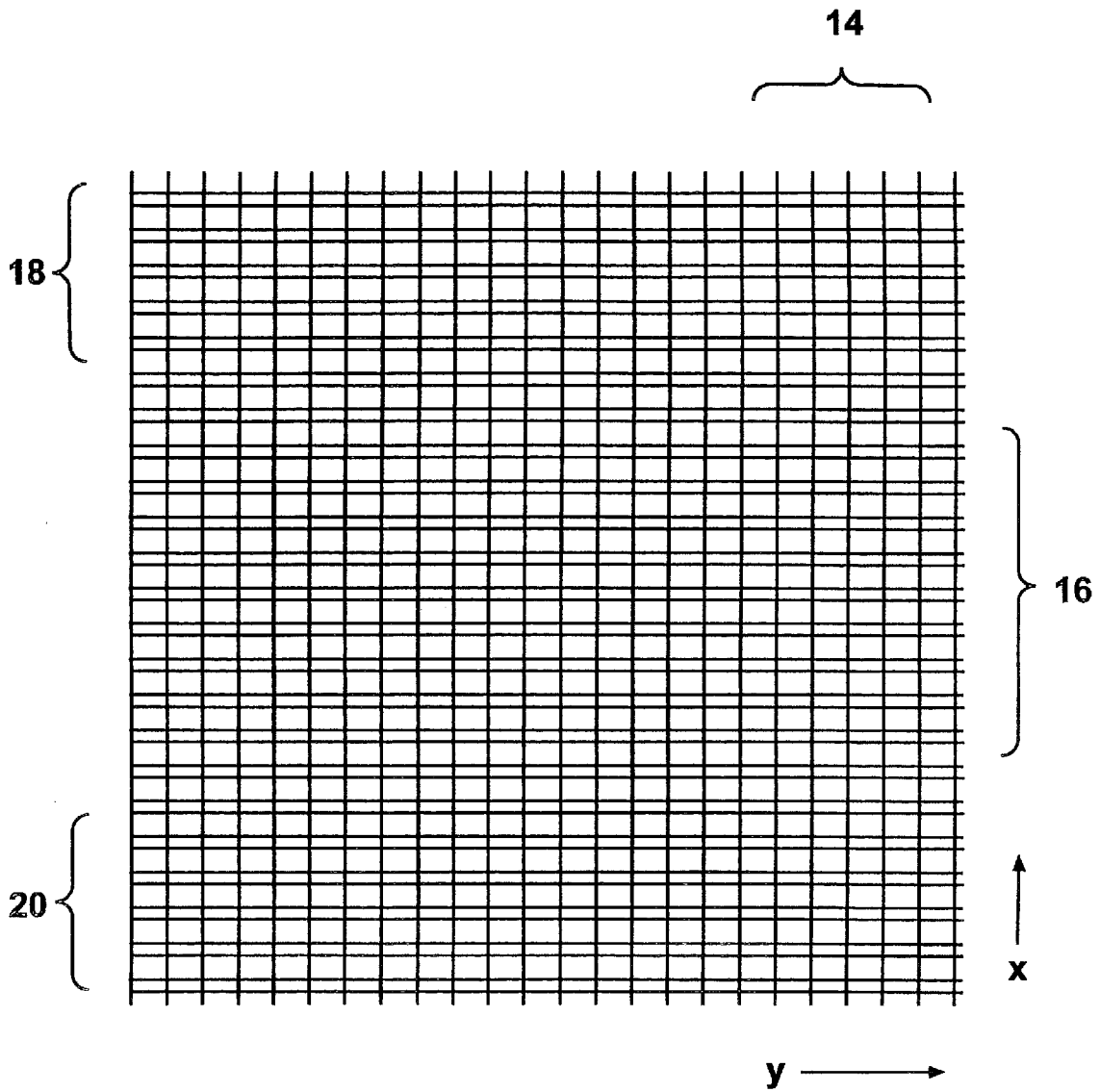

FIG. 3: is a front view of the tensioned lattices.

Figure 4:
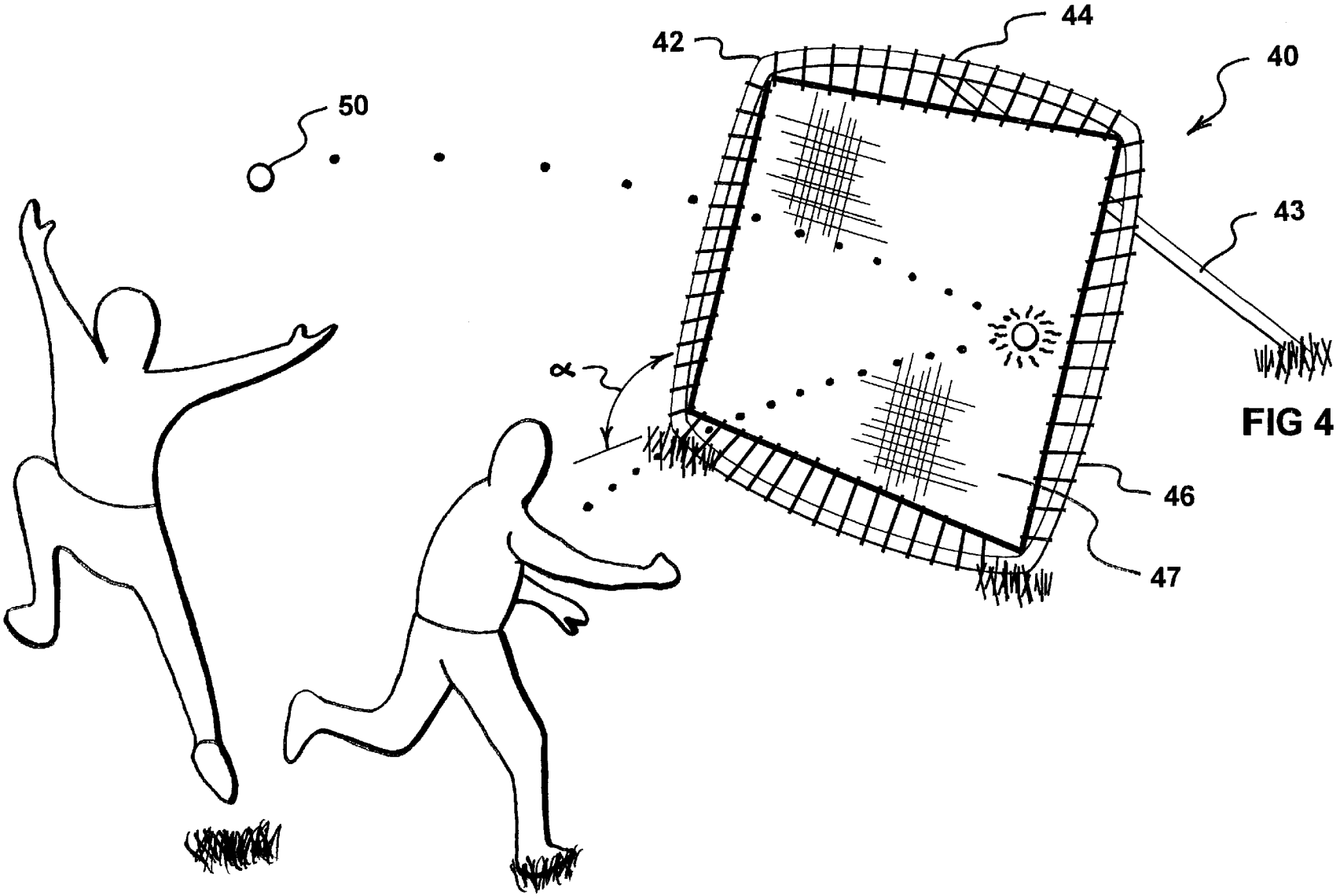

FIG. 4: is a perspective drawing of the invention in use.

Referring now to the drawings, the steel, tubular frame 2 (1000×1200 mm) has a pair of spikes 4 for locating the frame outdoors on grass. A strut (not shown) clips to the top of the frame and inclines the frame at the desired angle to the thrower, typically 100 degrees.

A net is made of a front lattice 6 and a rear lattice 8 each cell being about 60×60 mm. Four preferably metal or ALKATHENE® or other suitable tubes 10 (15 mm dia) are threaded through the outer most row of cells such that the assembly is smaller in area than the frame 2. A bungee cord 12 is wound about the tubes 10 and the frame 2 in order to tension the assembly. The tubes deform slightly. The tension is not so large as a tennis racquet but of that order.

The tensioning force is substantially equal upon the lattice in the x-axis and the y-axis. The lattices have the same cell size and close together under the tension in mutually perpendicular directions. When a ball is thrown at the net both lattices are displaced.

In FIG. 3 the arrangement of the lattices is shown with the strands 14 of the x-axis coincident while the strands of the y-axis provide a central band 16 about 300 mm deep running horizontally from tube to tube. Two outer bands 18, 20 of the same depth lie above and below. The cell spacing in the central band 16 in the x-axis varies but averages 30 mm. A thrown ball contacts the front lattice first and as it displaces the same the rear lattice is displaced.

A third lattice may be added to the net notwithstanding that the unpredictable rebound effect is derived mainly from two lattices. The third lattice provides an optional surface where the rebound is predictable and can be used by a user who prefers a more predictable return, for example, underarming the ball into the net and then batting the ball on its return.

The throwing and catching net 40 is placed usually leaning at a preferred reflex angle of 110°0 ( ) for optimal rebounding effect. The frame 42 is supported by a detachable strut 43 to maintain the frame at the desired angle ( ). The frame 42 is preferably constructed of galvanised tube or pipe of about 25 mm diameter. The frame is shown having slightly outwardly curved sides 44, 46 to counter the inward pulling force of the net 47 which can be as high as 200 kg when the net is not in use. This is naturally increased as a ball 50 is thrown at the net. It has been found that the optimal curvature of the sides is a displacement from a straight line of around 20 mm per metre of tube or pipe length beads 32 or like projections may be located in the lattices.

The unpredictability and speed of return of the ball are also directly related to the hardness and type of ball and the speed at which it is thrown against the net.

VARIATIONS

Finally, it will be appreciated that various other alterations and modifications may be made to the foregoing without departing from the scope of this invention as set forth.

Throughout the description and claims of this specification the word "comprise" and variations of that word, such as "comprises" and "comprising", are not intended to exclude other additives, components, integers or steps.

We claim:

1. A rebound device including in combination a frame member placeable upon a support surface and a planar member supported on the frame, the planar member having means for unpredictable rebound of a ball impacting with the planar member, wherein the planar member includes a primary ball contacting layer comprising a lattice and one or more secondary ball contacting layers and wherein in use, the ball when contacting with the planar member will rebound from the rebound device in an unpredictable manner.

2. A rebound device as claimed in claim 1 wherein the frame member has mounting means for erecting the frame member on the ground or other support surface.

3. A rebound device as claimed in claim 2 wherein the mounting means of the frame member comprises one or more struts which maintain the frame member at a reflex angle to the ground.

4. A rebound device as claimed in claim 1 wherein the frame member has ground engaging parts for locating one edge of the frame member on grass.

5. A rebound device as claimed in claim 1 wherein the frame member is galvanised pipe or tube.

6. A rebound device as claimed in claim 5 wherein the galvanised pipe or tube of the frame member is 25 mm in diameter.

7. A rebound device as claimed in claim 6 wherein sides of the frame member are curved for increased strength and to resist inwards pulling force of the net.

8. A rebound device as claimed in claim 7 wherein the curve of the sides of the frame member is about 20 mm per meter length of tube or pipe.

9. A rebound device as claimed in claim 1 wherein the lattices are sufficiently close to impart rebound energy to an object thrown at the net.

10. A rebound device as claimed in claim 1 wherein the lattices are in contact with one another.

11. A rebound device as claimed claim 1 wherein the lattices have rectangular cells.

12. A rebound device as claimed in claim 1 wherein the lattices have square cells.

13. A rebound device as claimed in claim 1 wherein the x-axis of strands of the lattices are coincidentally superimposed.

14. A rebound device as claimed in claim 13 wherein the y-axis strands of the lattices are not coincidentally superimposed.

15. A rebound device as claimed in claim 14 wherein spacing between the y-axis strands of the superimposed lattices is greater in a central area of the net than at a border area of the net.

16. A rebound device as claimed in claim 1 wherein the lattices are also staggered.

17. A rebound device as claimed in claim 16 wherein the lattices are 90 degrees out of phase so that cells in one axis appear to be only half the height of the cells at the edge of the net.

18. A rebound device as claimed in claim 17 further including wherein knots of the lattices, said knots influencing the rebound of the object thrown at the net.

19. A rebound device as claimed in claim 18 wherein one or both lattices have extra knots which are not part of the lattices to impart grip to the lattices.

20. A rebound device as claimed in claim 18 wherein one or both lattices have projections located in the lattices to import grip to the lattices.

21. A rebound device as claimed in claim 1 wherein there is a third lattice to provide the net with an optional predictable rebound surface.

22. A rebound device as claimed in claim 1 wherein the net comprises a single lattice having knobbly projections in a throwing direction so as to make contact with the object as it rebounds.

23. A rebound device as claimed in claim 1 wherein each impact of the object thrown at the net produces a different polygon of forces.

24. A rebound device as claimed in claim 1 wherein the net is polygonal in shape.

25. A rebound device as claimed in claim 1 wherein the net is circular is shape.

26. A rebound device as claimed in claim 1 wherein the net is oval in shape.

27. A rebound device as claimed in claim 1 wherein the net is rectangular in shape.

28. A rebound device as claimed in claim 1 wherein the net is stretched between tensioners suspended tautly within the frame member by resilient lattice holding means.

29. A rebound device as claimed in claim 28 wherein the resilient lattice holding means includes tension springs.

30. A rebound device as claimed in claim 28 wherein the resilient lattice holding means includes elastic cord.

31. A rebound device as claimed in claim 28 wherein the tensioners comprise one or more tubes of galvanised pipe.

32. A rebound device as claimed in claim 31 wherein the one or more tubes of the tensioners are threaded through alternative strands of the net while elastic cord is spirally wound between the lattices and around the said tubes and the frame.

33. A rebound device as claimed in claim 28 wherein the tensioners comprise one or more tubes of resilient material.

34. A rebound device as claimed in claim 33 wherein the one or more resilient tubes are made of polyethylene.

35. A rebound device as claimed in claim 1, wherein lattice has one or more cells of a perimeter that approaches the circumference of a defined ball.

36. A training apparatus for catching a sports ball comprising a sports ball having a defined circumference and a rebound device as claimed in claim 1.

37. A rebound device as claimed in claim 1 wherein the one or more secondary ball contacting layers comprises one or more lattices which are aligned or non-aligned with the lattice of the primary ball contacting layer to provide cells of a perimeter that approaches the circumference of a defined ball.

38. A rebound device as claimed in claim 1 in combination with a ball.

39. A rebound device as claimed in claim 1, wherein the ball used is a baseball.

40. A rebound device as claimed in claim 1, wherein the lattice has rectangular cells.

41. A method of practicing catching skills including the steps of:

1) preparing a rebound device having a pair of superimposes lattices,
2) throwing a ball against a rebound device so as to cause the ball to rebound in an unpredictable manner,
3) catching the ball, and
4) repeating steps (2) and (3).

42. A method of practicing batting skills including the steps of:

1) preparing a rebound device having a pair of superimposes lattices,
2) throwing a ball against a rebound device so as to cause the ball to rebound in an unpredictable manner,
3) batting the ball with a bat, and
4) repeating steps (2) and (3).

* * * * *